US007396318B2

(12) United States Patent
VanElverdinghe et al.

(10) Patent No.: US 7,396,318 B2
(45) **Date of Patent: *Jul. 8, 2008**

(54) SPRING ARRANGEMENT FOR A RECREATIONAL STRUCTURE

(75) Inventors: Jeffry L. VanElverdinghe, Beaverton, OR (US); Craig Adams, Portland, OR (US)

(73) Assignee: CA06, LLC, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/908,470

(22) Filed: May 12, 2005

(65) Prior Publication Data

US 2006/0258509 A1 Nov. 16, 2006

(51) Int. Cl.
*A63B 5/11* (2006.01)

(52) U.S. Cl. ..... 482/27

(58) Field of Classification Search ..... 482/26–29, 482/74, 77; 473/421; 5/233; 182/139; D21/797
See application file for complete search history.

(56) References Cited

U.S. PATENT DOCUMENTS

| | | | | |
|---|---|---|---|---|
| 2,370,990 | A * | 3/1945 | Nissen | 482/28 |
| 2,858,551 | A | 11/1958 | Sidlinger | |
| 2,991,841 | A * | 7/1961 | Sampson et al. | 482/27 |
| 3,031,688 | A | 5/1962 | Southwood | |
| 3,077,149 | A * | 2/1963 | Eckel | 267/89 |
| 3,233,895 | A * | 2/1966 | Grelle et al. | 482/27 |
| 3,502,330 | A * | 3/1970 | Cheftel | 273/395 |
| 3,938,792 | A | 2/1976 | Nissen | |
| 3,948,515 | A | 4/1976 | McNeil | |
| 3,983,585 | A | 10/1976 | Sidlinger | |
| 4,045,021 | A | 8/1977 | Nissen | |
| 4,139,192 | A | 2/1979 | McNeil | |
| RE30,344 | E | 7/1980 | McNeil | |
| 4,284,271 | A | 8/1981 | Pettit et al. | |
| 4,339,123 | A | 7/1982 | Rich | |
| 4,386,772 | A | 6/1983 | Wu | |
| 4,433,838 | A | 2/1984 | Gordon | |
| 4,489,933 | A | 12/1984 | Fisher et al. | |
| 4,548,405 | A | 10/1985 | Lee et al. | |
| 4,569,515 | A | 2/1986 | Gordon | |
| 4,576,375 | A | 3/1986 | Roberts | |
| 4,598,904 | A | 7/1986 | Roth | |
| 4,644,892 | A | 2/1987 | Fisher | |

(Continued)

FOREIGN PATENT DOCUMENTS

| | | |
|---|---|---|
| DE | 295 01 890 U1 | 3/1995 |

(Continued)

*Primary Examiner*—Jerome Donnelly
*Assistant Examiner*—Victor K. Hwang
(74) *Attorney, Agent, or Firm*—Joseph P. Curtin, L.L.C.

(57) ABSTRACT

A spring arrangement for a trampoline includes a rebounding surface, a frame structure having a top portion and a bottom portion, and a plurality of spring members that are mechanically coupled between the rebounding surface and the frame structure. A first group of spring members are mechanically coupled to the top portion of the frame structure and a second group of spring members are mechanically coupled to the bottom portion of the frame structure. In one exemplary embodiment, the spring members of the first group and the second group are alternately arranged along the frame structure. In another exemplary embodiment, the frame structure is formed by a plurality of frame members.

30 Claims, 4 Drawing Sheets

U.S. PATENT DOCUMENTS 4,730,826 A 3/1988 Sudmeier
4,776,581 A 10/1988 Shepherdson
4,836,530 A 6/1989 Stanley, Jr.
4,863,156 A 9/1989 Shaw
4,900,011 A 2/1990 Nolet
4,938,473 A 7/1990 Lee et al.
4,976,022 A 12/1990 Thornton et al.
5,299,989 A 4/1994 Boyd et al.
5,330,401 A 7/1994 Walstead
5,336,135 A 8/1994 Keyvani
5,371,936 A 12/1994 Blanchard
5,385,518 A 1/1995 Turner
5,477,599 A 12/1995 Blanchard
5,545,110 A * 8/1996 Hsiang ..... 482/27
5,674,157 A 10/1997 Wilkinson
5,810,695 A 9/1998 Sass
5,833,557 A 11/1998 Cole
5,941,798 A 8/1999 Coan et al.
6,001,045 A 12/1999 Gift et al.
6,017,292 A 1/2000 Gift et al.
6,053,845 A 4/2000 Publicover et al.
6,110,074 A 8/2000 Tacquet
6,139,474 A 10/2000 Gift et al.
6,162,061 A 12/2000 Taylor
6,193,632 B1 2/2001 Steger
6,237,169 B1 5/2001 Ying
6,261,207 B1 7/2001 Publicover et al.
6,283,894 B1 9/2001 Steger
6,319,174 B1 11/2001 Alexander
6,402,662 B1 6/2002 Rieber
6,508,682 B1 1/2003 Clark
6,560,795 B2 5/2003 Hsia
6,607,468 B1 8/2003 Nichols, Jr. et al.
6,648,799 B2 11/2003 Hall
6,676,546 B2 1/2004 Gordon
6,679,811 B2 1/2004 Chen
6,682,444 B2 1/2004 Gordon
6,733,420 B1 5/2004 Schroeder
6,742,202 B2 6/2004 Jones
6,840,891 B2 1/2005 Publicover
6,846,271 B2 * 1/2005 Publicover ..... 482/27
2001/0000250 A1 4/2001 Steger
2002/0098948 A1 7/2002 Yoon
2002/0137598 A1 9/2002 Publicover et al.
2002/0160884 A1 10/2002 Hall
2003/0036460 A1 2/2003 Publicover
2003/0104905 A1 6/2003 Publicover
2004/0107491 A1 6/2004 Publicover
2004/0121883 A1 6/2004 Publicover
2004/0171461 A1 9/2004 Alexander
2004/0171462 A1 9/2004 Alexander
2004/0176214 A1 9/2004 Yueh
2005/0032609 A1 2/2005 Nissen et al.
2005/0037896 A1 * 2/2005 Publicover ..... 482/27
2005/0054485 A1 3/2005 McDermott et al.
2007/0142180 A1 * 6/2007 Publicover et al. ..... 482/27

FOREIGN PATENT DOCUMENTS

EP 1 721 640 A1 8/2006
WO WO 02/13913 2/2002

* cited by examiner

SPRING ARRANGEMENT FOR A RECREATIONAL STRUCTURE

BACKGROUND

1. Field

The subject matter disclosed herein relates to recreational structures. More particularly, the subject matter disclosed herein relates to a spring arrangement for a recreational structure, such as a trampoline.

2. Description of the Related Art

FIG. 1 depicts the forces that are applied to a frame of a trampoline that has conventionally configured spring members. More specifically, FIG. 1 depicts a cross-sectional view of a frame 101 is part of, for example, a circular frame that forms the perimeter of a trampoline. Frame 101 is disposed on a vertical frame member 102, such as a leg of the trampoline. A spring member 103 mechanically connects a rebounding surface (not shown) to frame 101. In particular, a hook member 104 that is part of spring member 103 is inserted through a hole 105 (not plainly shown in FIG. 1) that is in the "top" of frame 101. Other spring members that are disposed behind spring member 103 and are not visible in FIG. 1 are mechanically connected to frame 101 in the same manner has shown in FIG. 1.

As the rebounding surface of the trampoline is jumped on, a horizontal force 106 and a vertical force 107 are applied to spring member 103 that is transmitted to frame 101. The nature of the mechanical connection of spring member 103 to frame 101, that is, the mechanical connection of hook member 104 through hole 105, causes a torque 108 to be applied to frame 101. Torque 108 causes vertical frame member 102 to bow outward from the center of the trampoline, as depicted by arrow 109.

The cyclic loading caused by torque 108 has a tendency to cause fatigue in vertical frame member 102 at the mechanical connection between frame 101 and vertical frame member 102 and along the length of vertical frame member 102.

What is needed is a technique for reducing the torque applied to a frame member of a trampoline, thereby minimizing the bowing and the fatigue caused in a vertical frame member of a trampoline.

BRIEF SUMMARY

The subject matter disclosed herein provides a technique for reducing the torque applied to a frame member of a trampoline, thereby minimizing the bowing and the fatigue caused in a vertical frame member of a trampoline.

The subject matter disclosed herein provides a spring arrangement for a trampoline that includes a rebounding surface, a frame structure having a top portion and a bottom portion, and a plurality of spring members that are mechanically coupled between the rebounding surface and the frame structure. According to the subject matter disclosed herein, a first group of spring members are mechanically coupled to the top portion of the frame structure and a second group of spring members are mechanically coupled to the bottom portion of the frame structure. In one exemplary embodiment, the spring members of the first group and the second group are alternately arranged along the frame structure. In another exemplary embodiment, the frame structure is formed by a plurality of frame members.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

The subject matter disclosed herein provides a technique for reducing the torque applied to a frame member of a trampoline, thereby minimizing the bowing and the fatigue caused in a vertical frame member of a trampoline.

Figure 1:
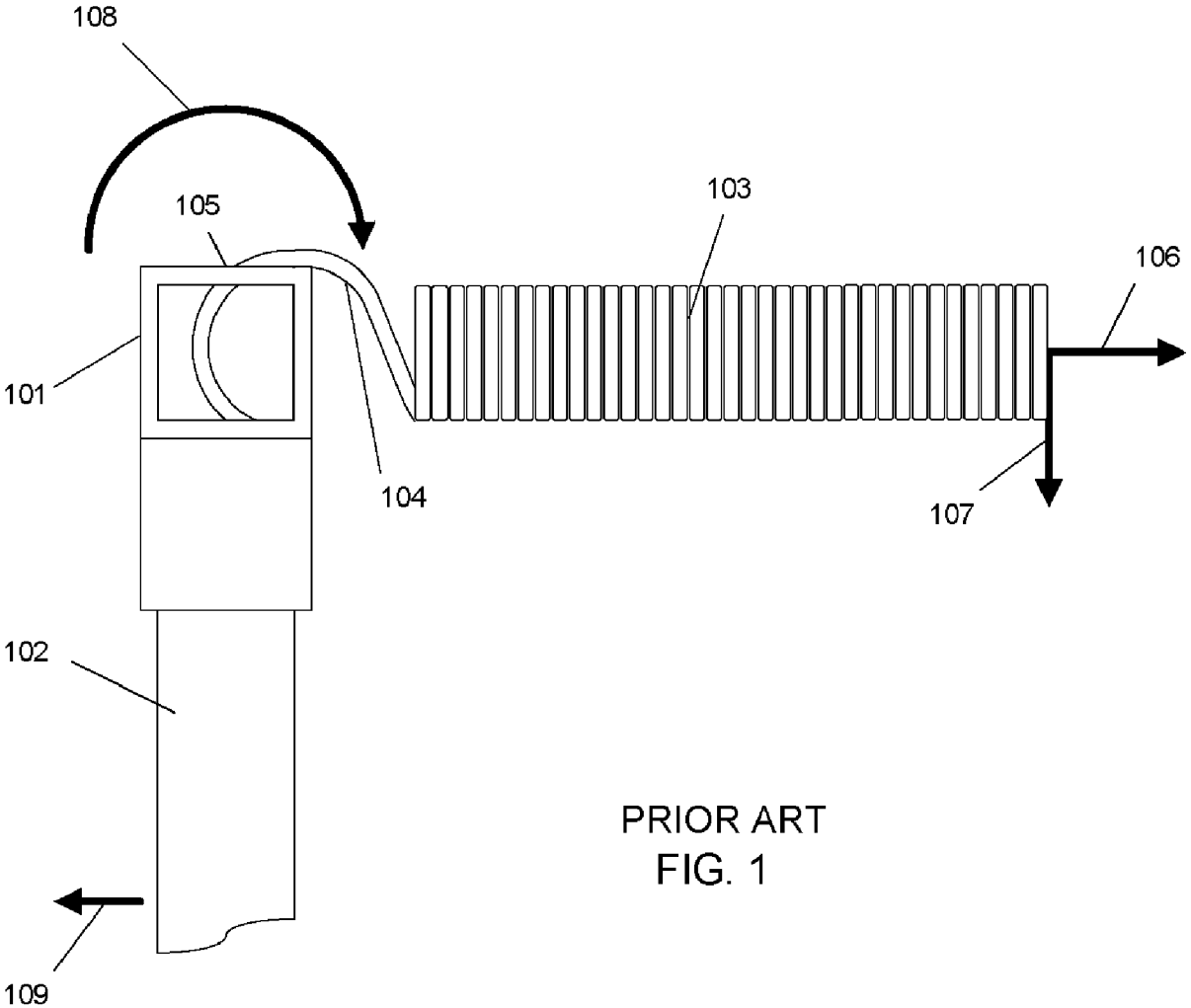
PRIOR ART FIG. 1
FIG. 1 depicts the forces that are applied to a frame of a trampoline that has conventionally configured spring members.
Figure 2:
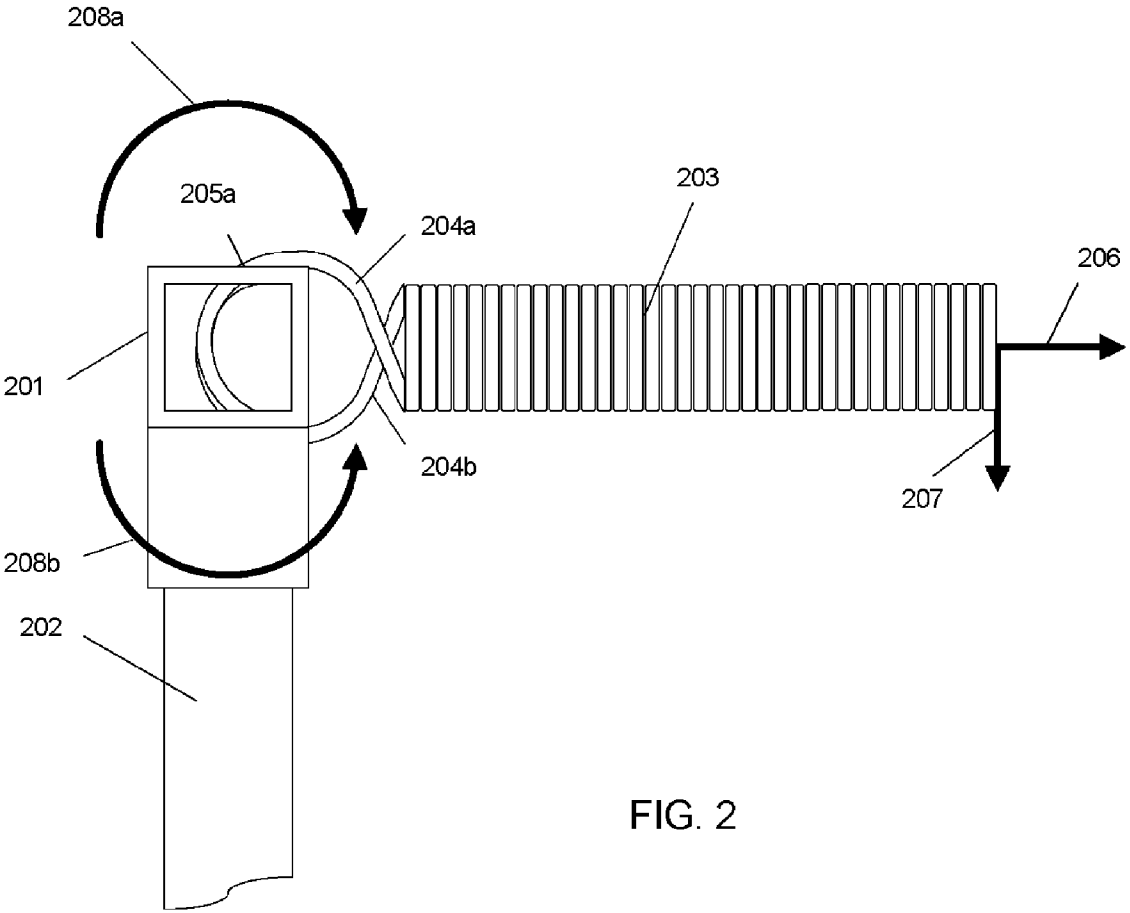
FIG. 2 depicts the forces that are applied to a frame of a trampoline that has spring members that are configured according to the subject matter disclosed herein.
Figure 3A:
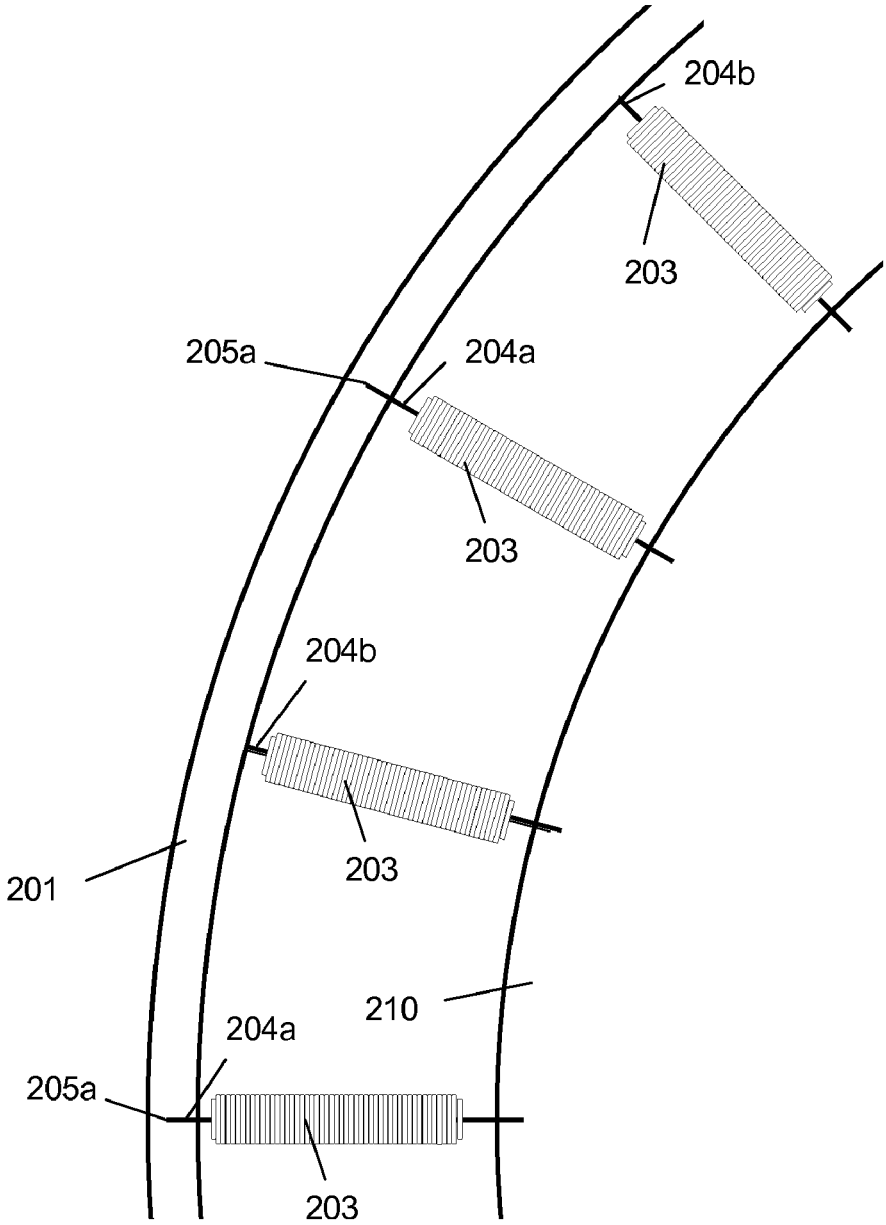
FIG. 3A is a top view of a portion of a trampoline that has spring members that are configured according to the subject matter disclosed herein.
Figure 3B:
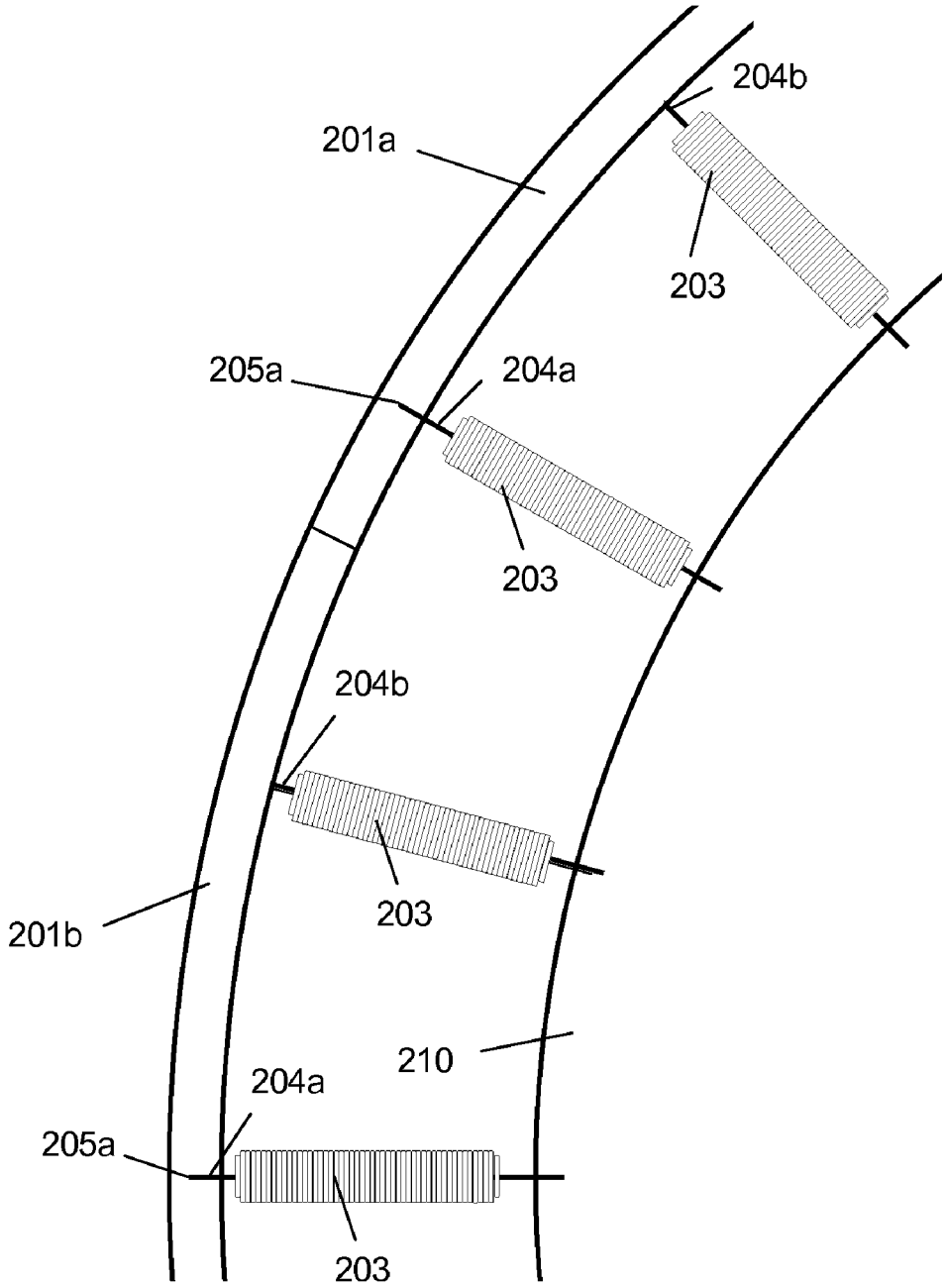
FIG. 3B is a top view of a portion of another embodiment of a trampoline that has spring member that are configured according to the subject matter disclosed herein.

FIG. 2 depicts the forces that are applied to a frame of a trampoline that has spring members that are configured according to the subject matter disclosed herein. More specifically, FIG. 2 depicts a cross-sectional view of a frame 201 is part of, for example, a circular frame that forms the perimeter of a trampoline. Frame 201 is disposed on a vertical frame member 202, such as a leg of the trampoline. A spring member 203 that is visible in FIG. 2 mechanically connects a rebounding surface 210 (not shown in FIG. 2) to frame 201. In particular, a hook member 204*a* that is part of spring member 203 is inserted through a hole 205*a* (not plainly shown in FIG. 2) that is in the "top" of frame 201. A second spring member that is disposed behind spring member 203 and that is not completely visible in FIG. 2 is mechanically connected to frame 201 by having a hook member 204*b* that is inserted through a hole (not visible in FIG. 2) that is in the "bottom" of frame 201. In one exemplary embodiment of the subject matter disclosed herein, all of the spring members that mechanically connect the rebounding surface to frame 201 are alternately connected to the "top" and "bottom" of frame 201. FIG. 3 is a top view of a portion of a trampoline that has spring members that are configured according to the subject matter disclosed herein.

As the rebounding surface of the trampoline is jumped on, a horizontal force 206 and a vertical force 207 are applied to spring member 203 that is transmitted to frame 201, as shown in FIG. 2. The alternating nature of each mechanical connection of spring members 203 to frame 201, that is, the mechanical connection of the corresponding hook member 204 through the top and bottom holes 205, cause a torque 208*a* and a torque 208*b* to be applied to frame 201. In particular, spring members that are mechanically connected to the "top" of frame 201 cause a torque 208*a* to be applied to frame 201. Spring members that are mechanically connected to the bottom of frame cause a torque 208*b* to be applied to frame 201. Torques 208*a* and 208*b* operate to cancel each other, and thereby reduces the tendency for vertical frame member 202 to bow outward from the center of the trampoline.

While FIG. 2 shows only a cross-sectional view of a portion of frame 201 and while FIG. depicts a unitary frame 201, it should be understood that frame 201 could be formed from a plurality of frame members (frame members 201*a*, 201*b* shown in FIG. 3B) that when assembled formfei a single frame structure.

Although the foregoing subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A trampoline, comprising:

a rebounding surface;

a single frame structure comprising a top portion and a bottom portion; and a plurality of spring members mechanically coupled between the rebounding surface and the single frame structure, a first group of spring members being mechanically coupled to the top portion of the single frame structure through an aperture in the top portion of the single frame structure and a second group of spring members being mechanically coupled to the bottom portion of the single frame structure through an aperture in the bottom portion of the single frame structure, and an end of each of the first group and second group of spring members that is coupled to the rebounding surface being in substantially the same plane.

2. The trampoline according to claim 1, wherein spring members of the first group and the second group are alternately arranged along the single frame structure.

3. The trampoline according to claim 2, wherein each spring member of the first group is adjacent to a spring member of the second group.

4. The trampoline according to claim 3, wherein each spring member of the first group is adjacent on two sides to a spring member of the second group.

5. The trampoline according to claim 2, wherein each spring member of the second group is adjacent to a spring member of the first group.

6. The trampoline according to claim 5, wherein each spring member of the second group is adjacent on two sides to a spring member of the first group.

7. The trampoline according to claim 2, wherein a first predetermined number of spring members of the first group is alternately arranged along the frame structure with a second predetermined number of spring members from the second group.

8. The trampoline according to claim 1, wherein the single frame structure comprises a plurality of frame members.

9. The trampoline according to claim 1, wherein spring members of the first group are arranged along the single frame structure to generate a torque that is applied to the frame structure in opposition to a torque generated by spring members of the second group.

10. The trampoline according to claim 1, wherein the rebounding surface is a single rebounding surface.

11. The trampoline according to claim 1, wherein the frame structure includes at least one frame member, the frame member having a top portion and a bottom portion, wherein the plurality of spring members mechanically are coupled between the rebounding surface and the frame member, and wherein the first group of spring members is mechanically coupled to the top portion of the frame member and the second group of spring members is mechanically coupled to the bottom portion of the frame member.

12. A trampoline, comprising:

a single rebounding surface comprising a single edge;

a frame structure comprising a top portion and a bottom portion; and a plurality of spring members mechanically coupled between the single edge of the single rebounding surface and the frame structure, a first group of spring members of the plurality of spring members being mechanically coupled to the top portion of the frame structure through an aperture in the top portion of the frame structure and a second group of spring members of the plurality of spring members being mechanically coupled to the bottom portion of the frame structure through an aperture in the bottom portion of the frame structure.

13. The trampoline according to claim 12, wherein the frame structure comprises a plurality of frame members.

14. The trampoline according to claim 12, wherein spring members of the first group and the second group are alternately arranged along the frame structure.

15. The trampoline according to claim 14, wherein each spring member of the first group is adjacent to a spring member of the second group.

16. The trampoline according to claim 15, wherein each spring member of the first group is adjacent on two sides to a spring member of the second group.

17. The trampoline according to claim 14, wherein each spring member of the second group is adjacent to a spring member of the first group.

18. The trampoline according to claim 17, wherein each spring member of the second group is adjacent on two sides to a spring member of the first group.

19. The trampoline according to claim 14, wherein a first predetermined number of spring member of the first group is alternately arranged along the frame structure with a second predetermined number of spring members from the second group.

20. The trampoline according to claim 12, wherein spring members of the first group are arranged along the frame structure to generate a torque that is applied to the frame structure in opposition to a torque generated by spring members of the second group.

21. The trampoline according to claim 12, wherein the frame structure includes at least one frame member, the frame member having a top portion and a bottom portion, wherein the plurality of spring members mechanically are coupled between the rebounding surface and the frame member, and wherein the first group of spring members is mechanically coupled to the top portion of the frame member and the second group of spring members is mechanically coupled to the bottom portion of the frame member.

22. A trampoline, comprising:

a rebounding surface;

a frame structure having at least one frame member, the frame member comprising a top portion and a bottom portion; and a plurality of spring members mechanically coupled between the rebounding surface and the frame member, a first group of spring members being mechanically coupled to the top portion of the frame member through an aperture in the top portion of the frame structure and a second group of spring members being mechanically coupled to the bottom portion of the frame member through an aperture in the bottom portion of the single frame structure, and an end of each of the first group and second group of spring members that is coupled to the rebounding surface being in substantially the same plane.

23. The trampoline according to claim 22, wherein the frame structure comprises a plurality of frame members.

24. The trampoline according to claim 23, wherein each spring member of the first group is adjacent to a spring member of the second group.

25. The trampoline according to claim 23, wherein each spring member of the second group is adjacent to a spring member of the first group.

26. The trampoline according to claim 23, wherein a first predetermined number of spring member of the first group is alternately arranged along the frame member with a second predetermined number of spring members from the second group.

27. The trampoline according to claim 22, wherein spring members of the first group and the second group are alternately arranged along the frame member.

28. The trampoline according to claim 27, wherein each spring member of the first group is adjacent on two sides to a spring member of the second group.

29. The trampoline according to claim 28, wherein each spring member of the second group is adjacent on two sides to a spring member of the first group.

30. The trampoline according to claim 22, wherein spring members of the first group are arranged along the frame member to generate a torque that is applied to the frame structure in opposition to a torque generated by spring members of the second group.

* * * * *